US011384547B2

(12) United States Patent
Lai

(10) Patent No.: US 11,384,547 B2
(45) Date of Patent: Jul. 12, 2022

(54) METHOD OF CONSTRUCTING HOLLOW WALL STRUCTURE

(71) Applicant: Chien-Cheng Lai, Chiayi (TW)

(72) Inventor: Chien-Cheng Lai, Chiayi (TW)

( * ) Notice: Subject to any disclaimer, the term of this patent is extended or adjusted under 35 U.S.C. 154(b) by 424 days.

(21) Appl. No.: 16/577,098

(22) Filed: Sep. 20, 2019

(65) Prior Publication Data

US 2021/0087837 A1 Mar. 25, 2021

(51) Int. Cl.

| | |
|---|---|
| ***E04G 15/06*** | (2006.01) |
| ***E04B 2/84*** | (2006.01) |
| ***E04B 1/76*** | (2006.01) |
| ***E04B 2/86*** | (2006.01) |

(52) U.S. Cl.

CPC ..... *E04G 15/061* (2013.01); *E04B 2/84* (2013.01); *E04B 1/7616* (2013.01); *E04B 2/8617* (2013.01)

(58) Field of Classification Search

CPC ..... E04G 15/061; E04B 2/84; E04B 1/7616; E04B 2/8617; E04B 5/326; E04C 1/40; E04C 5/168; E04C 2/044

USPC ..... 52/2.15, 323, 381, 382, 576, 577, 742.1

See application file for complete search history.

(56) References Cited

U.S. PATENT DOCUMENTS

| | | | | |
|---|---|---|---|---|
| 1,275,668 | A * | 8/1918 | Fillippone | E04B 5/19 52/329 |
| 2,116,557 | A * | 5/1938 | Billner | E04B 2/84 264/87 |
| 2,520,912 | A * | 9/1950 | Cheney | E04C 1/41 52/415 |
| 4,206,163 | A * | 6/1980 | DeCoster | B28B 7/082 264/256 |
| 4,224,274 | A * | 9/1980 | Ozawa | B28B 11/245 264/333 |
| 4,808,360 | A * | 2/1989 | Natori | B28B 1/26 264/221 |
| 5,858,295 | A * | 1/1999 | McDowell | B29C 45/4478 264/314 |
| 2015/0322664 | A1* | 11/2015 | Manning | E04C 5/073 52/742.15 |
| 2018/0112389 | A1* | 4/2018 | Lake | E04B 7/04 |

* cited by examiner

*Primary Examiner* — Basil S Katcheves
*Assistant Examiner* — Omar F Hijaz
(74) *Attorney, Agent, or Firm* — Alan D. Kamrath; Karin L. Williams; Mayer & Williams PC

(57) ABSTRACT

A method of constructing a hollow wall structure comprising: a step (A) of constructing a grout wall mold; a step (B) of grouted a curable liquid material into the grouting space; a step (C) of removing the first template wall and the second template wall so as to produce a semi-finished hollow wall having the Styrofoam board; and a step (D) of removing a semi-finished hollow wall having the Styrofoam board so as to obtain a hollow wall having a communication space. The communication space has an inflow conduit and a connection channel.

3 Claims, 13 Drawing Sheets

METHOD OF CONSTRUCTING HOLLOW WALL STRUCTURE

FIELD OF THE INVENTION

The present invention relates to a method of constructing a hollow wall structure is applicable for a building.

BACKGROUND OF THE INVENTION

A conventional wall of a reinforced concrete building is a solid wall, and the wall is waterproofed by applying waterproof material on the inner and outer surfaces of the wall. However, the waterproof martial is failed after a period of using time, and heat in the building cannot be dissipated.

The present invention has arisen to mitigate and/or obviate the afore-described disadvantages.

SUMMARY OF THE INVENTION

One aspect of the present invention is to provide a method of constructing a hollow wall which avoids a low temperature and a high temperature in the building.

Another aspect of the present invention is to provide a method of constructing a hollow wall which obtains sound insulation and vibration absorption.

To obtain the above, a method of constructing a hollow wall provided by the present invention contains:

a step (A) of constructing a grout wall mold, wherein the first step including: a first sub-step (A1) of constructing a first template wall; a second sub-step (A4) of constructing a first steel grid frame which extends from a rear side of the first template wall; a third sub-step (A3) of fixing a Styrofoam board on a rear end of the first steel grid frame back to the first template wall; a fourth sub-step (A4) of mounting a second steel grid frame which is separated from the first steel grid frame by the Styrofoam board; and a fifth sub-step (A5) of constructing a second template wall on a rear end of the second steel grid frame back to Styrofoam board so that a grouting space is defined among the first template wall, the Styrofoam board, a first extension of the Styrofoam board, multiple second extensions of the Styrofoam board, and the second template wall;

a step (B) of grouted a curable liquid material into the grouting space, wherein a top of the curable liquid material is lower than or is flushed with a top of the first extension;

a step (C) of removing the first template wall and the second template wall so as to produce a semi-finished hollow wall having the Styrofoam board; and a step (D) of removing the semi-finished hollow wall having the Styrofoam board so as to obtain a hollow wall having a communication space, wherein the communication space has an inflow conduit and a connection channel.

DETAILED DESCRIPTION OF THE PREFERRED EMBODIMENTS

Figure 1:
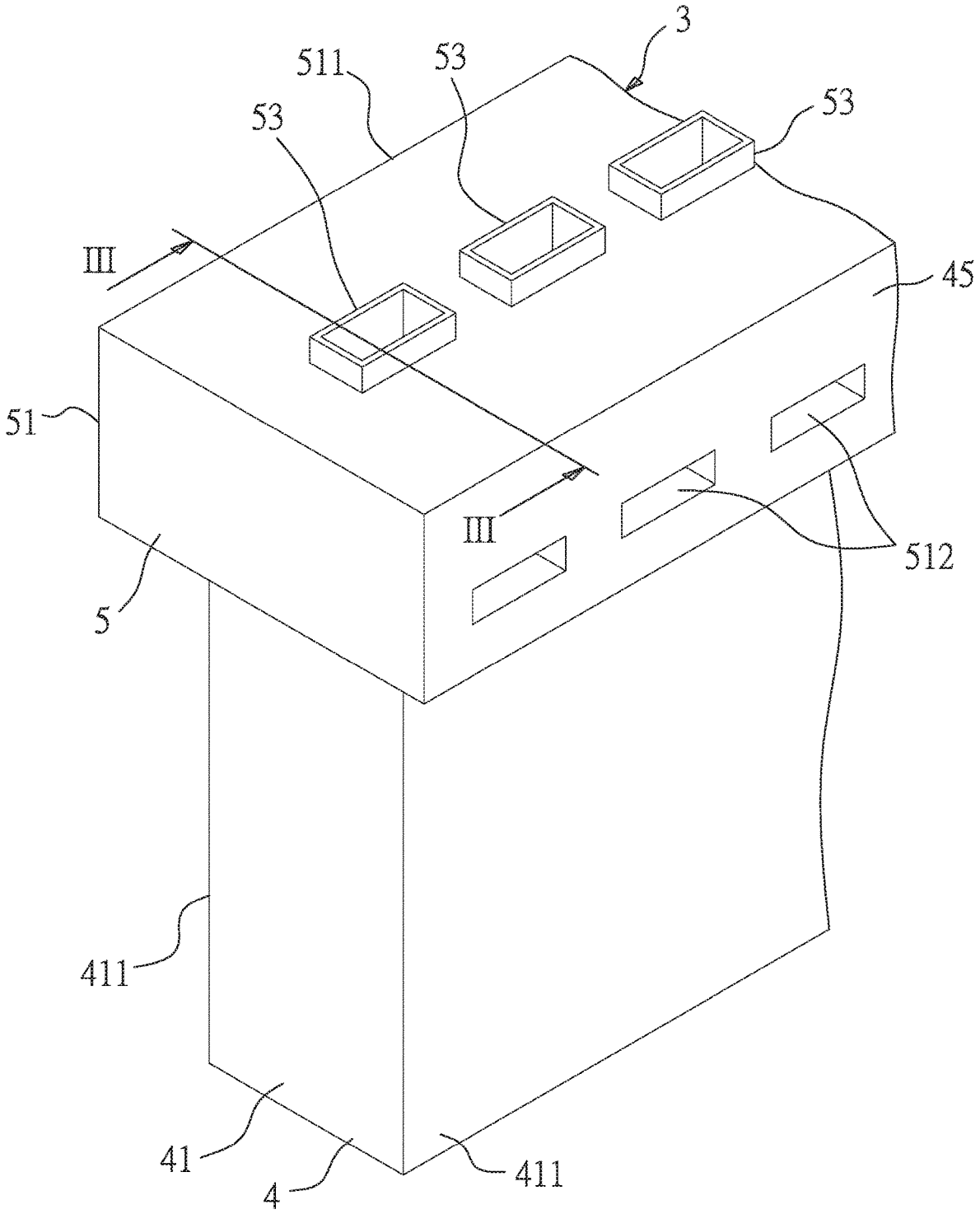
FIG. 1 is a perspective view of a hollow wall structure of a building according to a preferred embodiment of the present invention.
Figure 2:
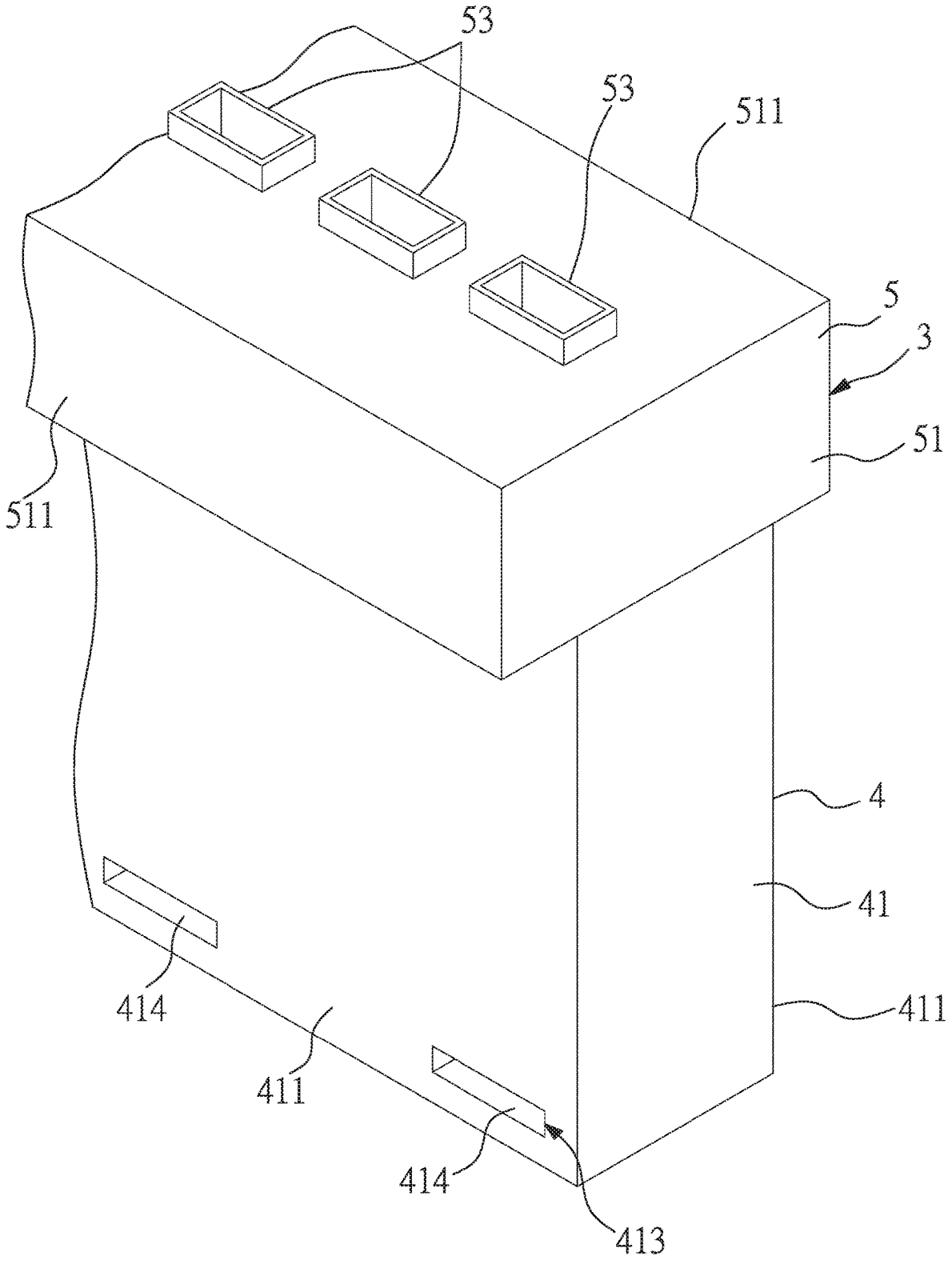
FIG. 2 is another perspective view of the hollow wall structure of the building according to the preferred embodiment of the present invention.
Figure 3:
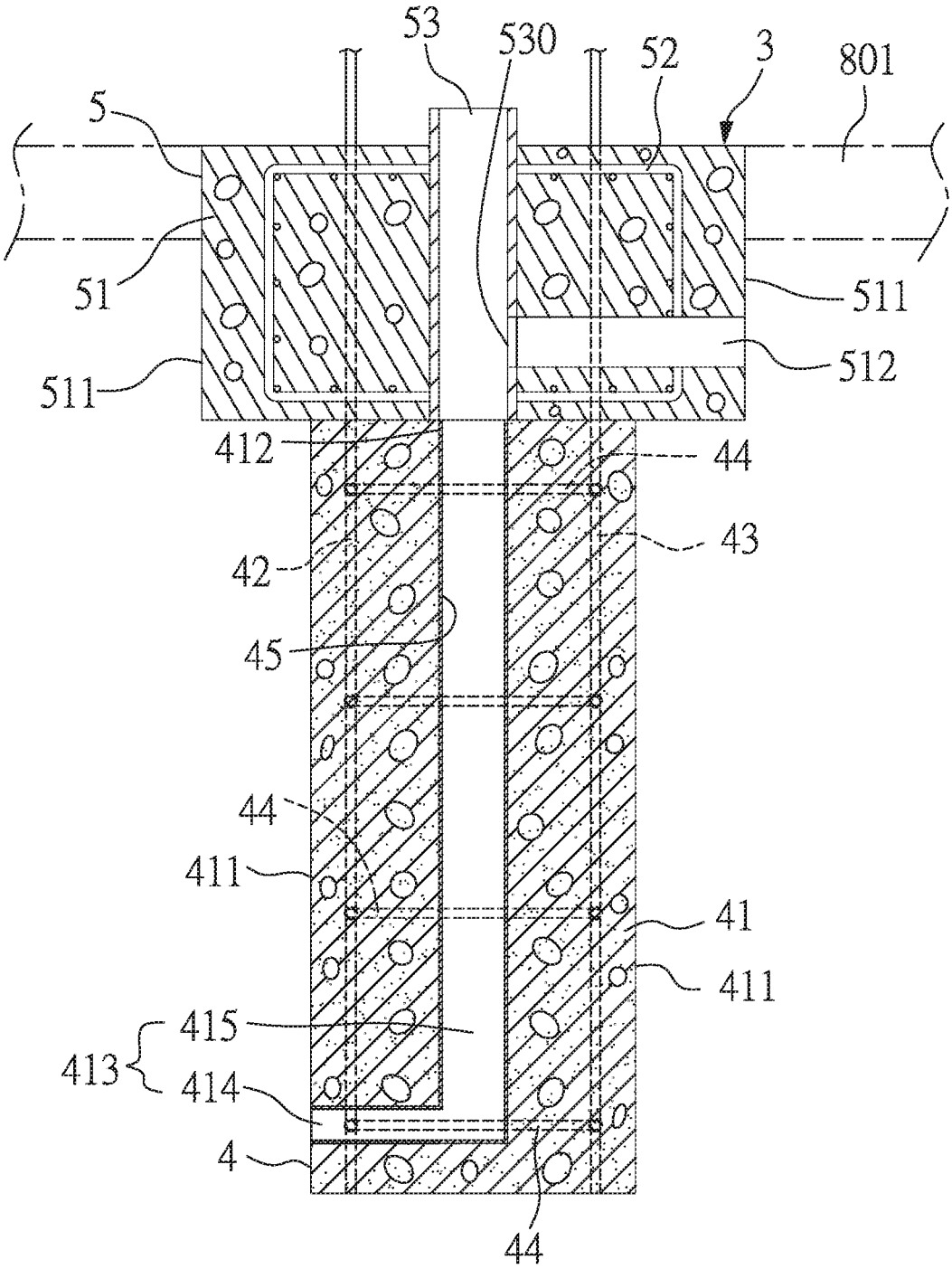
FIG. 3 is a cross sectional view taken along the line III-III of FIG. 1.

With reference to FIGS. 1-3, a method of constructing a hollow wall structure 3 according to a preferred embodiment of the present invention is applicable for a wall of a building, and the wall is an exterior wall or a partition wall of the building.

Figure 4:
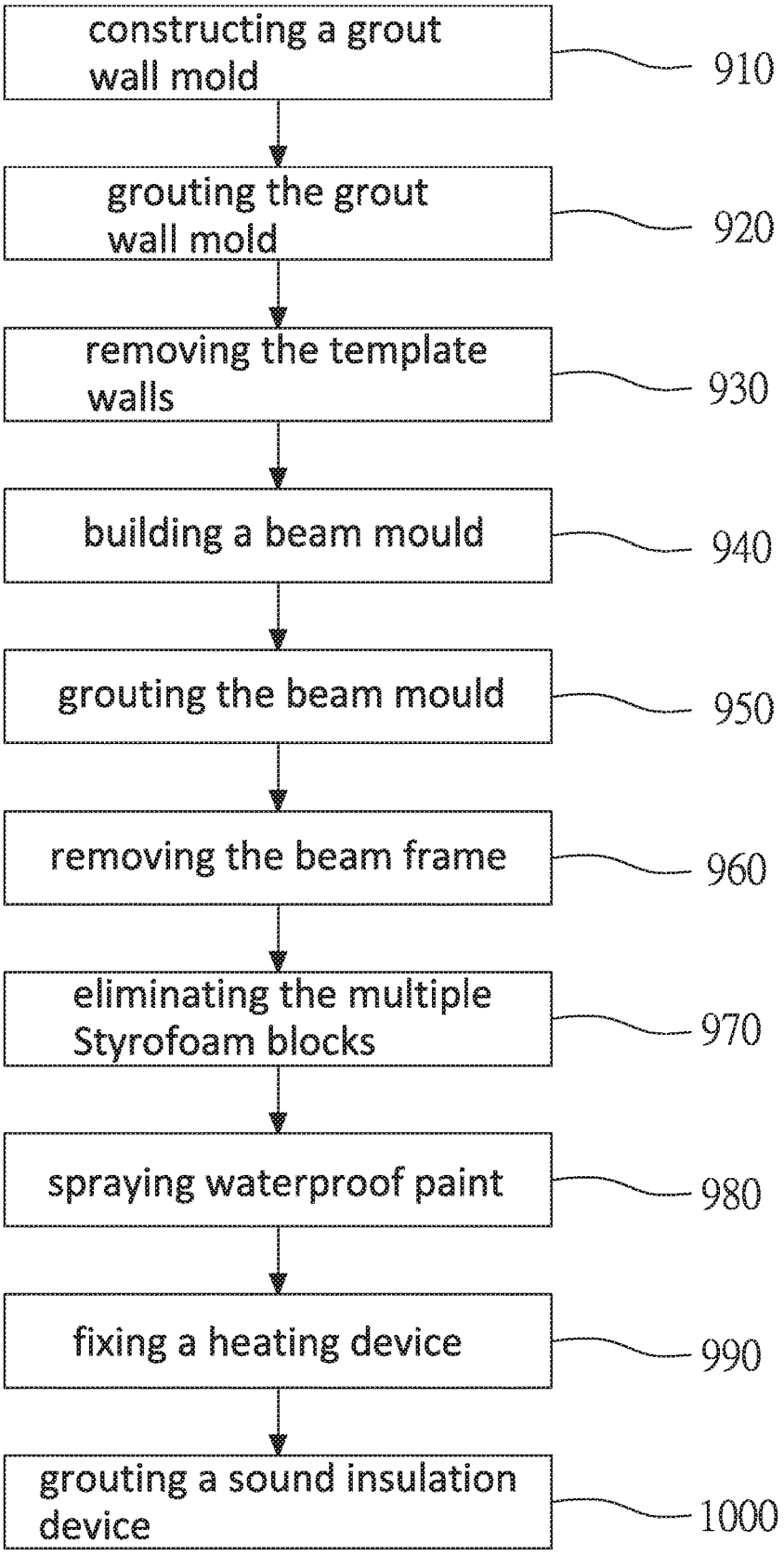
FIG. 4 is a flow chart of a method of constructing a hollow wall according to the preferred embodiment of the present invention.
Figure 5:
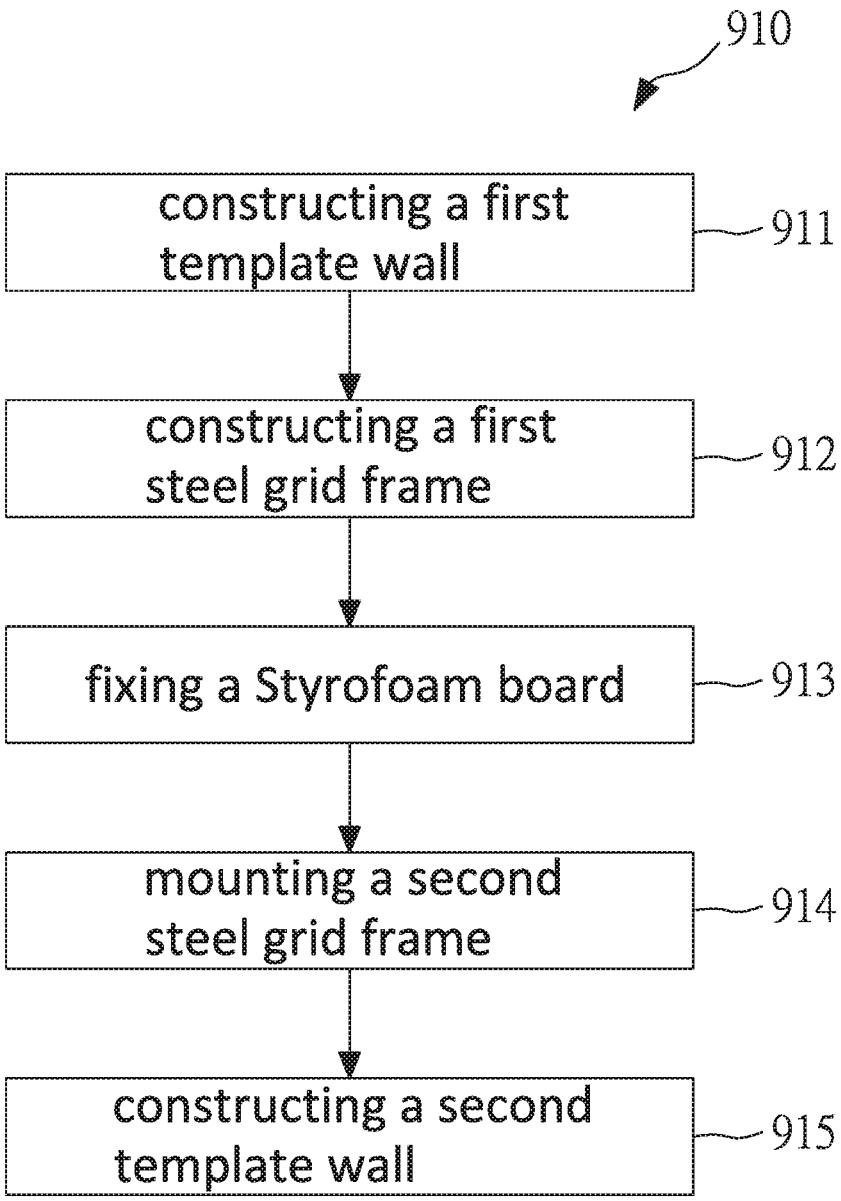
FIG. 5 is a flow chart of constructing a grout wall mold according to the preferred embodiment of the present invention.
Figure 6:
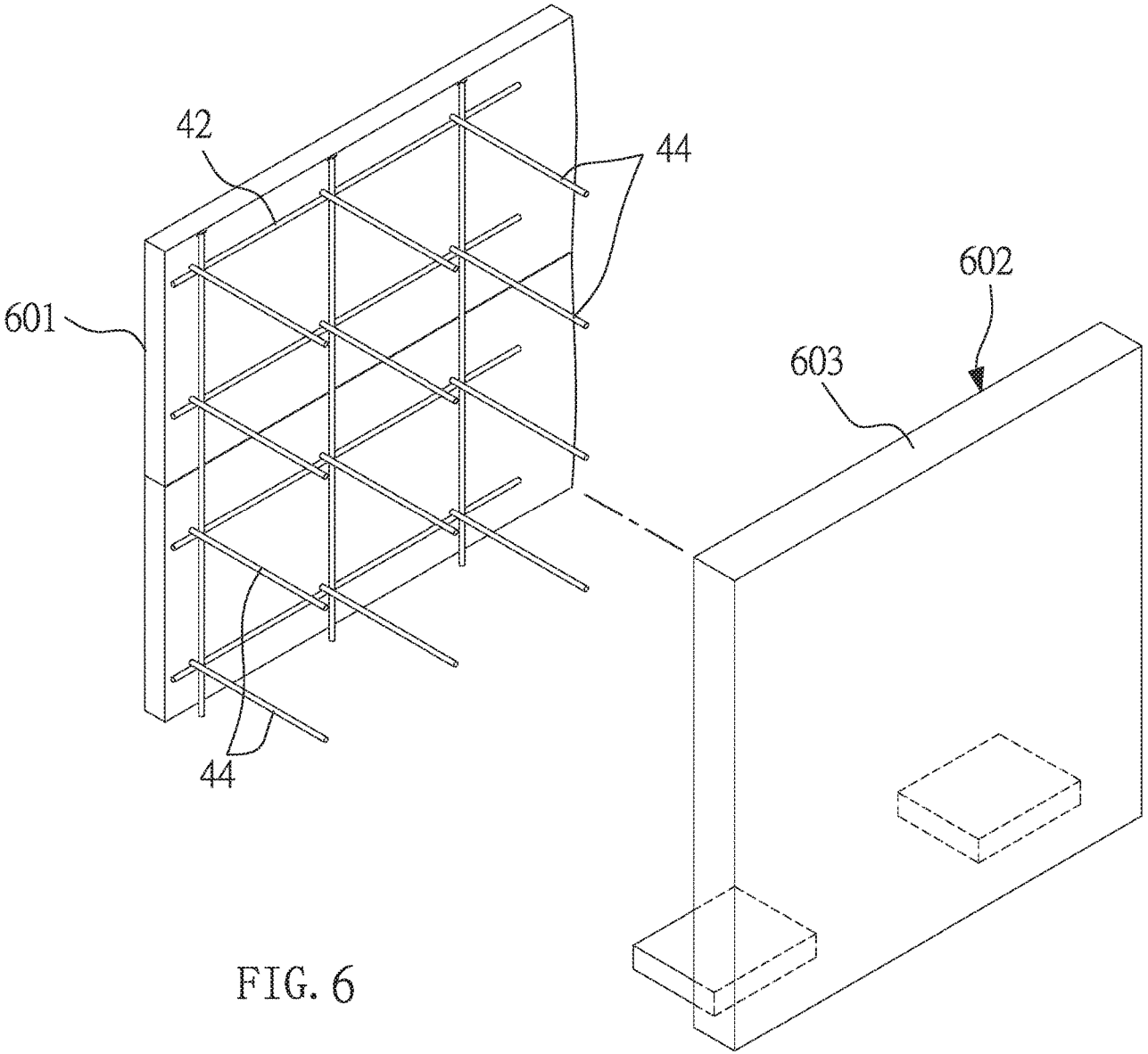
FIG. 6 is a perspective view showing the operation of the method of constructing the hollow wall according to the preferred embodiment of the present invention.
Figure 7:
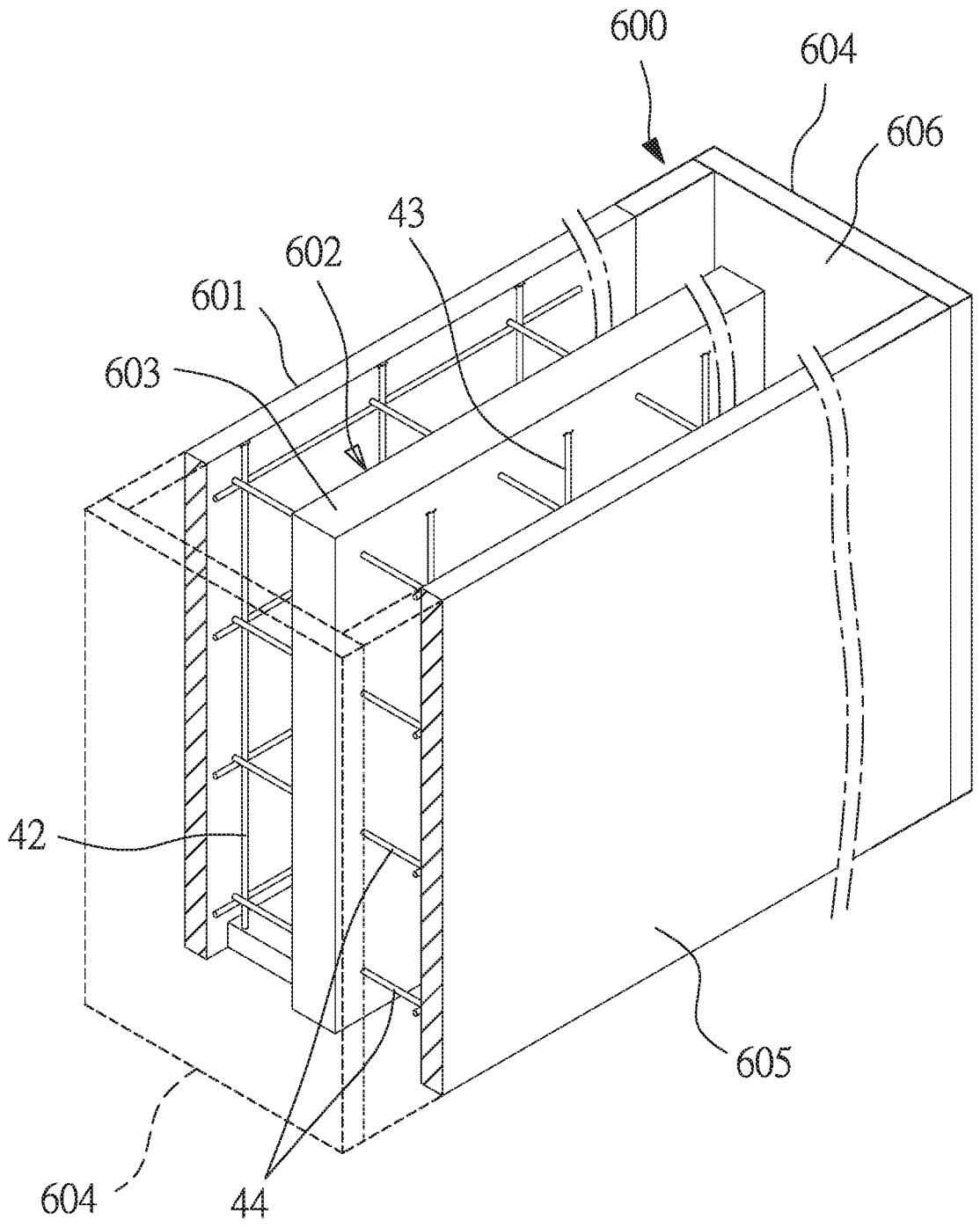
FIG. 7 is a cross-sectional perspective view showing the operation of the method of constructing the hollow wall according to the preferred embodiment of the present invention.
Figure 8:
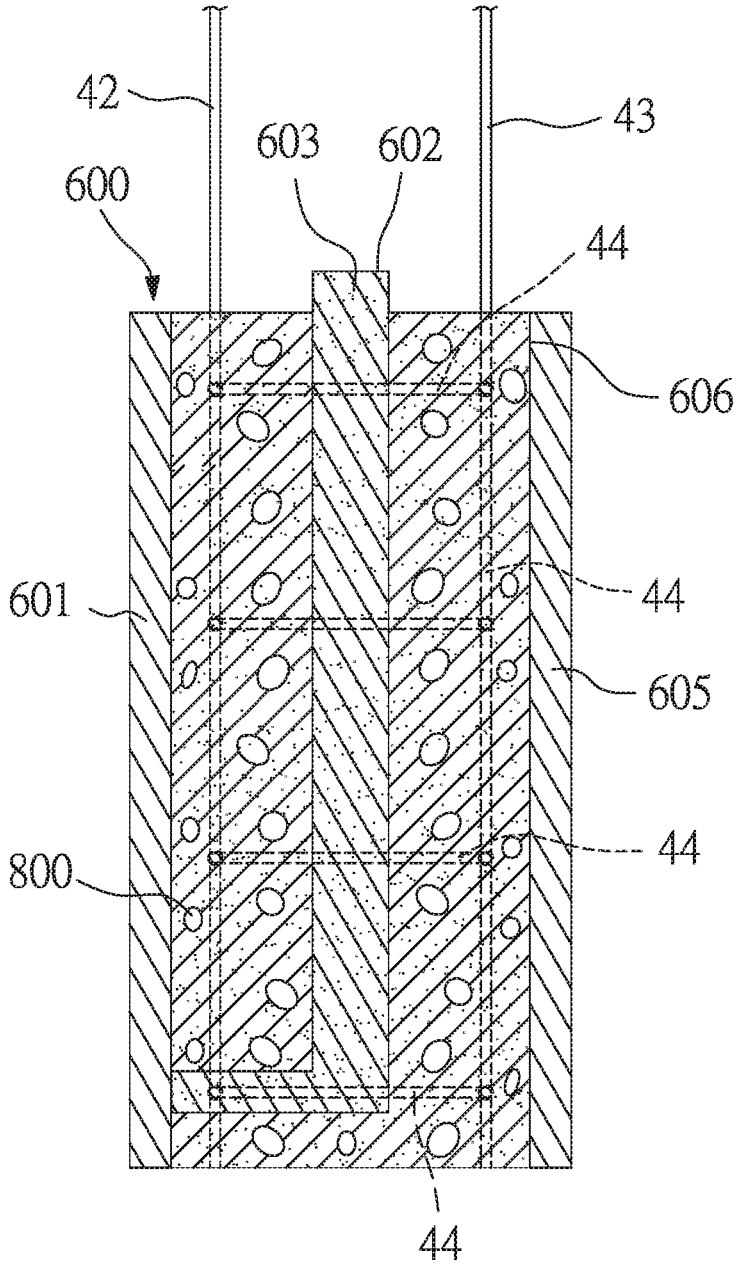
FIG. 8 is a cross sectional view showing the operation of the method of constructing the hollow wall according to the preferred embodiment of the present invention.

The method of constructing the hollow wall structure 3 comprises:

a first step 910 of constructing a grout wall mold 600, as shown in FIGS. 4-6, wherein the first step 910 including:

a first sub-step 911 of constructing a first template wall 601, wherein the first template wall 601 is constructed on a ground based on a height and a length of a hollow wall 4;

a second sub-step 912 of constructing a first steel grid frame 42, wherein the first steel grid frame 42 extending from a rear side of the first template wall 601;

a third sub-step 913 of fixing a Styrofoam board 602 by ways of multiple positioning posts 44, as shown in FIGS. 5-7, wherein the Styrofoam board 602 has a first extension 603 formed thereon, multiple second extensions 604 spaced apart from each other and located beside two sides of the first extension 603 individually, wherein front ends of the multiple positioning post 44 are connected with the first steel grid frame 42, and rear ends of the multiple positioning post 44 extend away from the first steel grid frame 42, wherein the multiple positioning post 44 are made of stainless steel, and the Styrofoam board 602 abuts against rear ends of the multiple positioning post 44, wherein the multiple positioning posts 44 are inserted through the first extension 603, and the multiple second extensions 604 pass across the first steel grid frame 42 to contact with a rear surface of the first template wall 601, the first extension 603 is behind the first steel grid frame 42 and is configured to fix the multiple second extensions 604 with the first template wall 601;

a fourth sub-step 914 of mounting a second steel grid frame 43, wherein the second steel grid frame 43 is separated from the first steel grid frame 42 by the Styrofoam board 602, and rear ends of the multiple positioning post 44 are connected on the second steel grid frame 43;

a fifth sub-step 915 of constructing a second template wall 605, as illustrated in FIGS. 5, 7, and 8, wherein the second template wall 605 is fixed on a rear end of the second steel grid frame 43 back to Styrofoam board 602 so that the second template wall 605 corresponds to the first template wall 601, and two ends of the second template wall 605 are connected with the first template wall 601 via the multiple second extensions 604, wherein a grouting space 606 is defined among the first template wall 601, the Styrofoam board 602, the first extension 603, the multiple second extensions 604, and the second template wall 605 so as to finish the grout wall mold 600, wherein the grouting space 606 has an opening facing upward.

Preferably, a sequence of the multiple sub-steps of the main step 910 is changeable based on using requirements.

Figure 9:
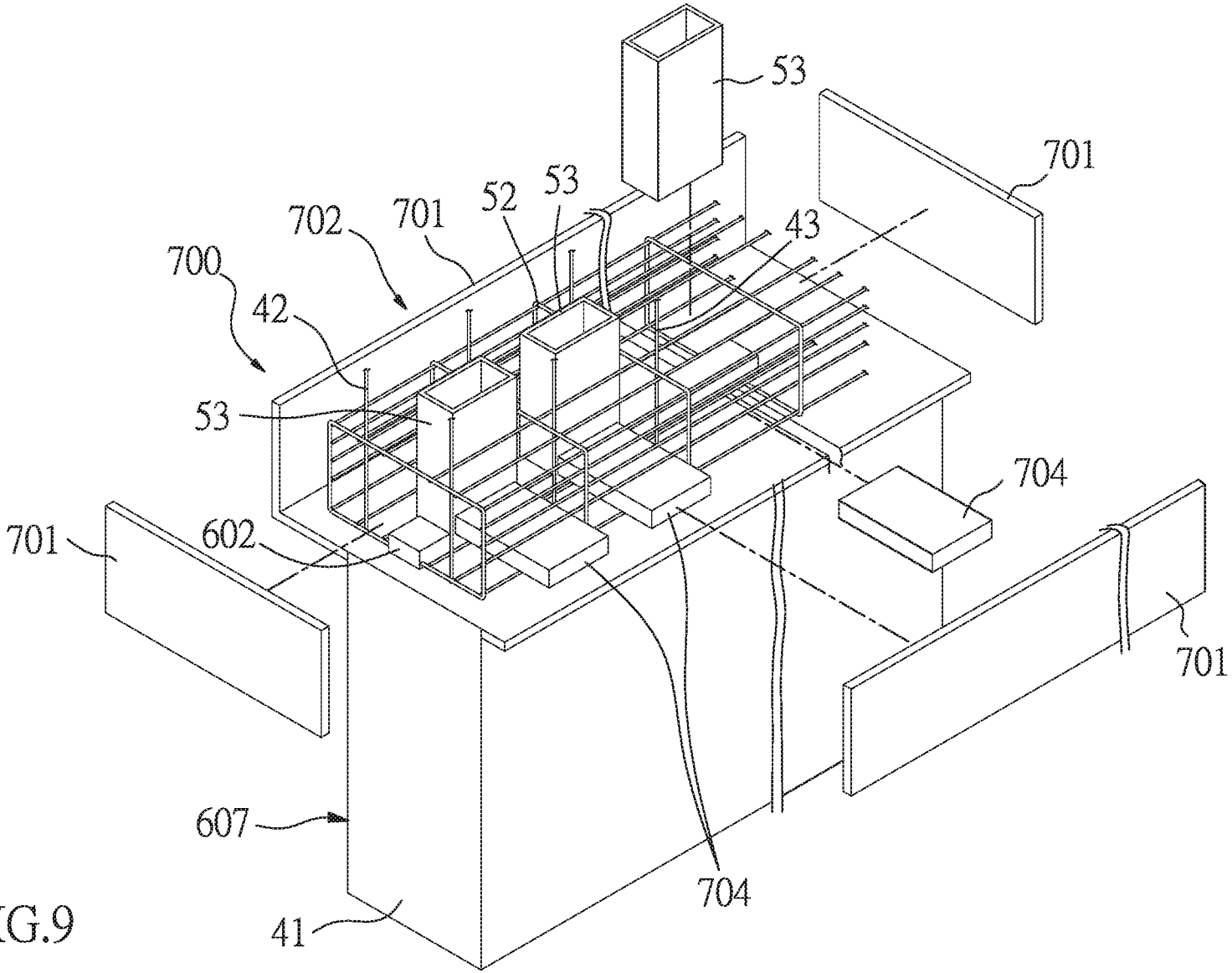
FIG. 9 is another perspective view showing the operation of the method of constructing the hollow wall according to the preferred embodiment of the present invention.
Figure 10:
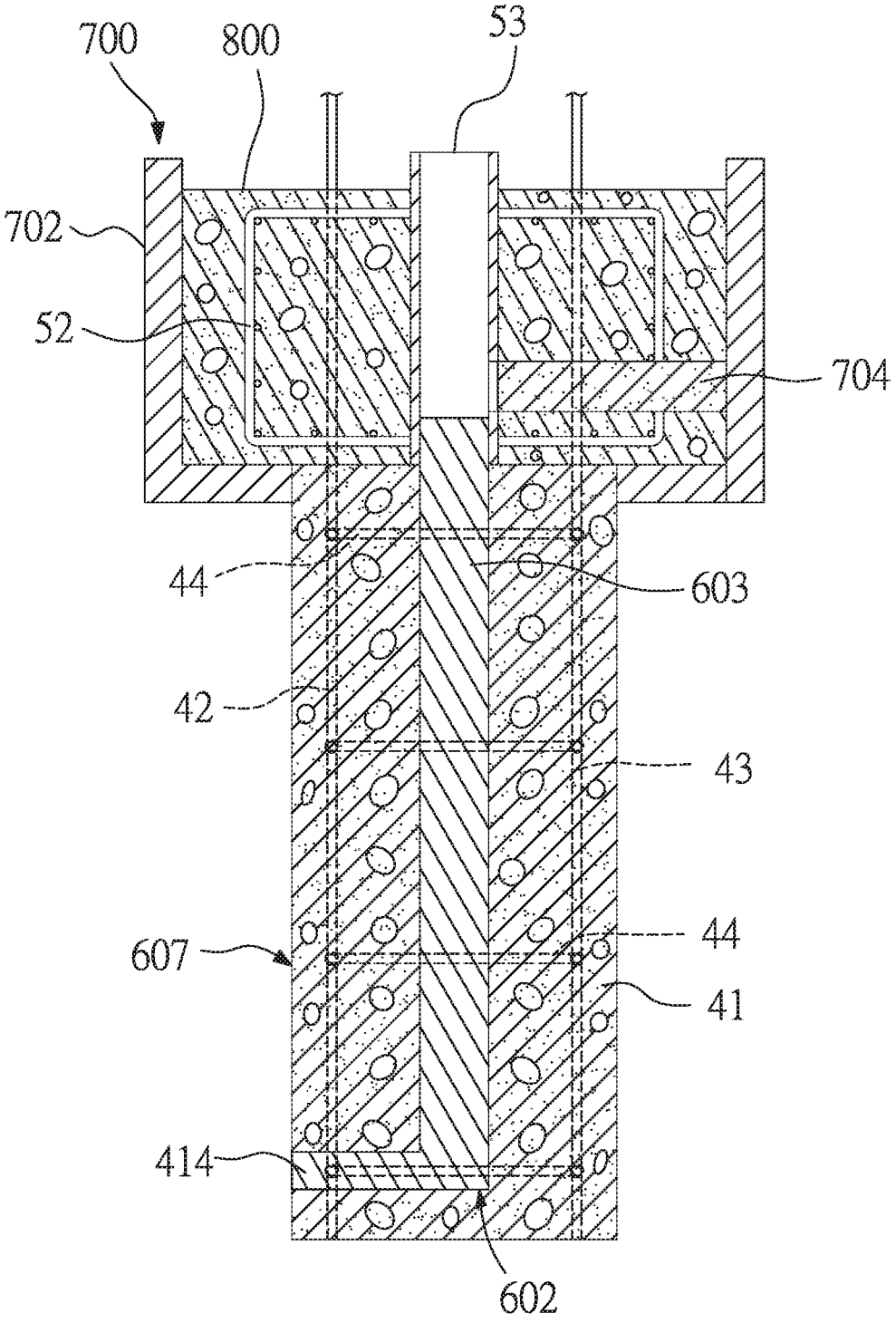
FIG. 10 is another cross sectional view showing the operation of the method of constructing the hollow wall according to the preferred embodiment of the present invention.

The method of constructing the hollow wall structure 3 further comprises:

a second step 920 of grouting the grout wall mold 600, wherein a curable liquid material 800 is grouted into the grouting space 606, and the curable liquid material 800 is concrete pulp, wherein a top of the curable liquid material 800 in the grouting space 606 is lower than or is flushed with a top of the Styrofoam board 602;

a third step 930 of removing the template walls, as shown in FIGS. 5, 8, and 9, wherein the first template wall 601 and the second template wall 605 are removed after the curable liquid material 800 are solidified so as to form a wall body 41, thus producing a semi-finished hollow wall 607 having the Styrofoam board 602;

a fourth step 940 of building a beam mould 700, as illustrated in FIGS. 4, 9, and 10, wherein the beam mould 700 is built along a top of the semi-finished hollow wall 607, and the beam mould 700 has a beam reinforcement 52 connected on the first steel grid frame 42 and exposed outside the second steel grid frame 43, a beam frame 702 surrounding the beam reinforcement 52, connected on the top of the semi-finished hollow wall 607, and having an opening facing upward, multiple connection pipes 53 separately extending through the beam reinforcement 52, and multiple Styrofoam blocks 704 separately extending across the beam reinforcement 52, wherein the beam frame 702 is defined by a plurality of templates 701.

A width of the beam frame 702 is more than a thickness of the semi-finished hollow wall 607, and a bottom of each of the multiple connection pipes 53 abuts against the top of the semi-finished hollow wall 607 and is shielded by the Styrofoam board 602. A front end of each of the multiple Styrofoam blocks 704 contacts with an outer wall of each connection pipe 53, and a rear end of each Styrofoam block 704 abuts against one of the plurality of templates 701 behind the beam frame 702.

Figure 11:
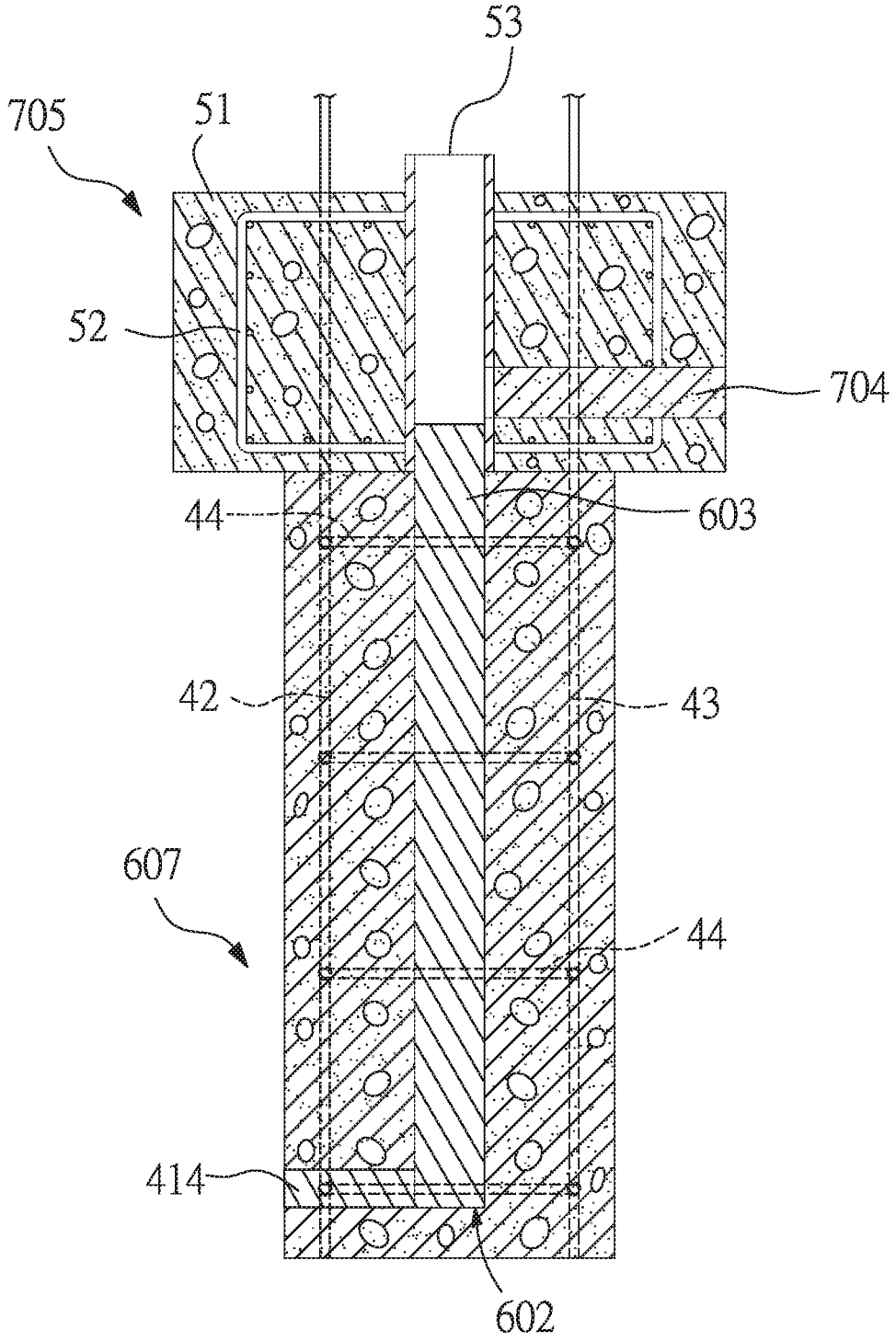
FIG. 11 is also another cross sectional view showing the operation of the method of constructing the hollow wall according to the preferred embodiment of the present invention.

The method of constructing the hollow wall structure 3 further comprises:

a fifth step 950 of grouting the beam mould 700, wherein the curable liquid material 800 is filled into the beam frame 702 so as to cover the beam reinforcement 52 and the multiple Styrofoam blocks 704, wherein the curable liquid material 800 is not higher than tops of the multiple connection pipes 53;

a sixth step 960 of removing the beam frame 702, as shown in FIGS. 4, 10, and 11, wherein after the curable liquid material 800 is solidified to form a beam body 51, the beam frame 702 is removed so as to produce a semi-finished bean 705 having the multiple Styrofoam blocks 704;

a seventh step 970 of eliminating the multiple Styrofoam blocks 704 of the semi-finished beam 705, as shown in FIGS. 3, 4, and 11, wherein the semi-finished beam 705 includes multiple air passages 512 formed on the multiple Styrofoam blocks 704 respectively, and the multiple connection pipes 53 have multiple orifices 530 defined thereon and corresponding to the multiple air passages 512 respectively, thus producing a beam 5 connected on the top of the semi-finished hollow wall 607. In this embodiment, the multiple Styrofoam blocks 704 are eliminated by spraying a solvent.

Thereafter, the solvent is filled to the multiple Styrofoam blocks 704 from tops of the multiple connection pipes 53 so as to melt the first extension 603 and the second extension 604 of the Styrofoam board 602 in the semi-finished hollow wall 607, thus obtaining the hollow wall 4 having a communication space 413. The solvent and melted Styrofoam board discharge out of an inflow conduit 414.

The method of constructing the hollow wall structure 3 further comprises:

an eighth step 980 of spraying waterproof paint, wherein the waterproof paint is sprayed into the communication space 413 and the multiple air passages 512 from the tops of the multiple connection pipes 53 so as to adhere on the hollow wall 4, and an internal fence 412 of the communication space 413 is defined and has a waterproof layer 45, thus finishing the hollow wall structure 3.

When building the building by using the hollow wall structure 3, an outflow tube arrangement (not shown) is connected with the tops of the multiple connection pipes 53 so as to define a ventilation system by ways of the communication space 413, the tops of the multiple connection pipes 53, and the multiple air passages 512.

The beam 5 is mounted on a ceiling 801 so that the multiple air passages 512 are located on positions of the ceiling individually, and the multiple air passages 512 are connected with at least one exhaust fan (not shown) so as to draw hot air into the multiple air passages 512 from the ceiling, and the hot air discharges out of the ventilation system. If a fire happens, smokes are discharged out of the ventilation system via the multiple air passages 512. Preferably, the communication space 413 of the hollow wall 4 avoids a low temperature in a winter and a high temperature in a summer. Furthermore, the waterproof layer 45 of the hollow wall 4 is formed on the internal fence 412, thus prolonging a service life of the waterproof layer 45.

In another embodiment, as desiring to construct multiple hollow wall structures 3 in the building which has two floors or more than the two floors, the main step 910 to the sixth step 960 are executed repeatedly after finishing the main step 910 to the sixth step 960, and the semi-finished bean 705 has another semi-finished hollow wall 607 and another semi-finished bean 705, thus constructing multiple hollow wall structures 3.

Thereafter, the seventh step 970 of eliminating the multiple Styrofoam blocks 704 is executed, and the eighth step 980 of spraying the waterproof layer 45 is executed, thus finishing the hollow wall structure 3, as shown in FIGS. 1-3.

In another embodiment, the hollow wall structure 3 comprises the hollow wall 4, and the communication space 413 of the hollow wall 4 is communicated with the outflow tube arrangement, thus forming a ventilation system.

Figure 12:
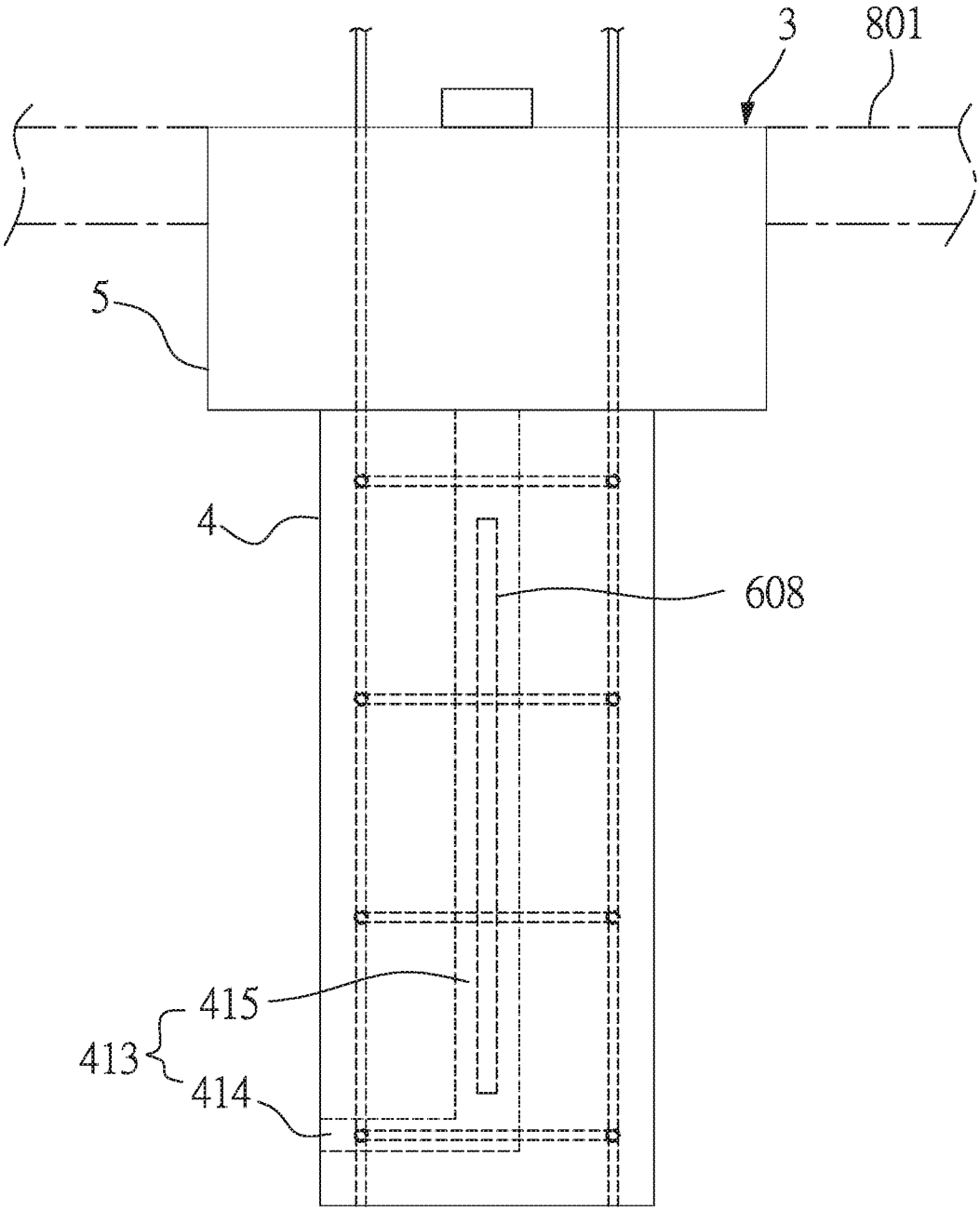
FIG. 12 is still another cross sectional view showing the operation of the operation of the method of constructing the hollow wall according to the preferred embodiment of the present invention.
Figure 13:
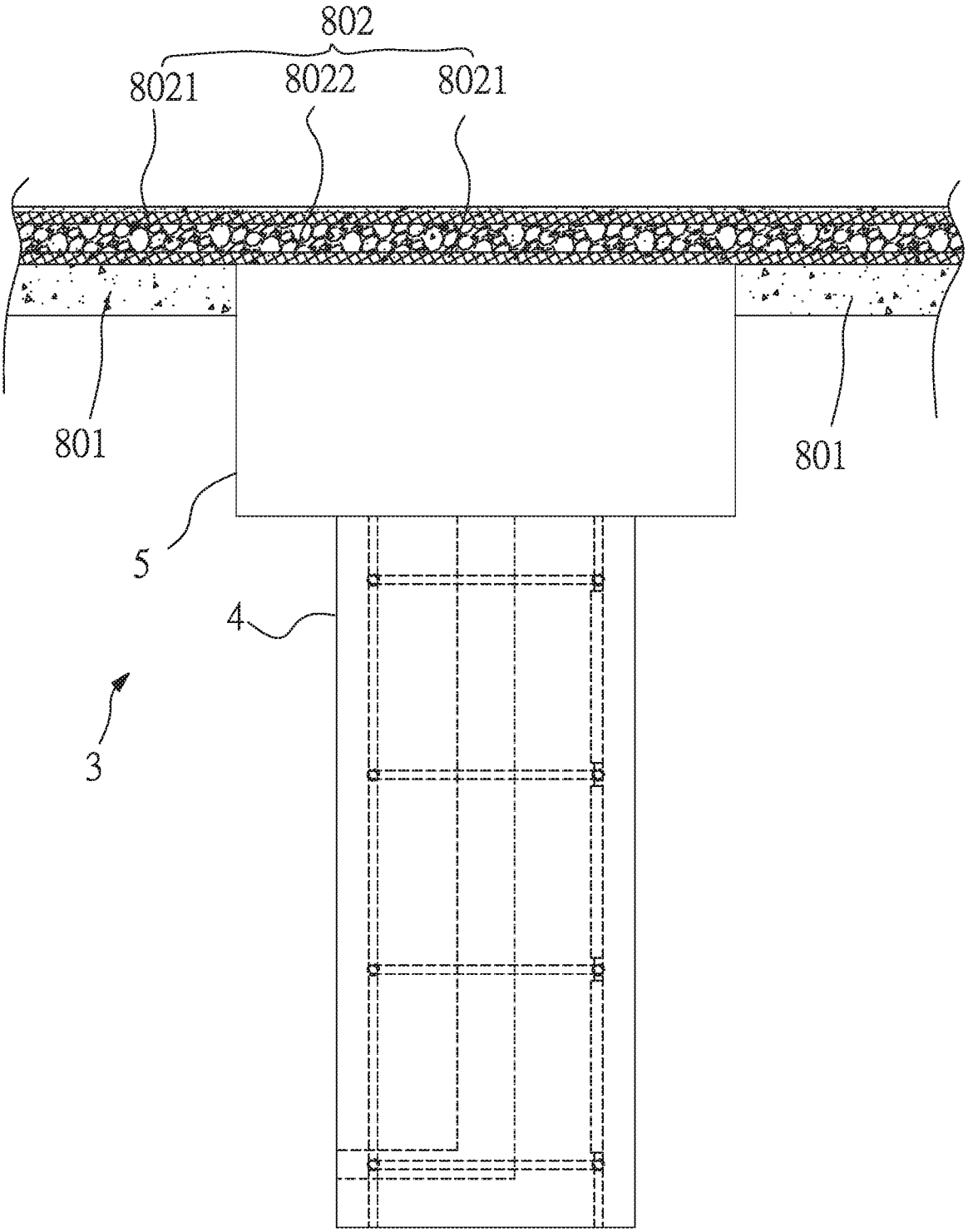
FIG. 13 is another cross sectional view showing the operation of the operation of the method of constructing the hollow wall according to the preferred embodiment of the present invention.

Referring to FIG. 12, the method of constructing the hollow wall structure 3 further comprises:

a ninth step 990 of fixing a heating device 608 in the communication space 413 of the hollow wall 4, wherein the communication space 413 has an inflow conduit 414 or a connection channel 415 in which the heating device 608 is fixed so as to supply warm air into the building via the hollow wall 4, wherein the heating device 608 is any one of a cooling chip, a cold and heat exchange tube, and a heat pump;

a tenth step 1000 of grouting a sound insulation device 802 of the ceiling 801, as shown in FIG. 13, wherein the beam 5 is connected with the ceiling 801 and has the sound insulation device 802 arranged thereon, the sound insulation device 802 has a metal mesh 8021, a sound absorbing foam 8022, and another metal mesh 8021 which are solidified after grouting, wherein the sound absorbing foam 8022 is defined between the two metal meshes 8021, thus obtaining sound insulation and vibration absorption.

While the preferred embodiments of the invention have been set forth for the purpose of disclosure, modifications of the disclosed embodiments of the invention as well as other embodiments thereof may occur to those skilled in the art. The scope of the claims should not be limited by the preferred embodiments set forth in the examples, but should be given the broadest interpretation consistent with the description as a whole.

What is claimed is:

1. A method of constructing a hollow wall structure comprising:

a step (A) of constructing a grout wall mold, wherein the first step including: a first sub-step (A1) of constructing a first template wall; a second (A2) of constructing a first steel grid frame which extends from a rear side of the first template wall; a third sub-step (A3) of fixing a Styrofoam board on a rear end of the first steel grid frame back to the first template wall; a fourth sub-step (A4) of mounting a second steel grid frame which is separated from the first steel grid frame by the Styrofoam board; and a fifth sub-step (A5) of constructing a second template wall on a rear end of the second steel grid frame back to Styrofoam board so that a grouting space is defined among the first template wall, the Styrofoam board, a first extension of the Styrofoam board, multiple second extensions of the Styrofoam board, and the second template wall;

a step (B) of grouting a curable liquid material into the grouting space, wherein a top of the curable liquid material is lower than or is flushed with a top of the first extension;

a step (C) of removing the first template wall and the second template wall so as to produce a semi-finished hollow wall having the Styrofoam board; and a step (D) of removing the semi-finished hollow wall having the Styrofoam board so as to obtain a hollow wall having a communication space, wherein the communication space has an inflow conduit and a connection channel, wherein in the third sub-step (A3), the Styrofoam board is fixed between the first steel grid frame and the second steel grid frame by ways of multiple positioning posts, front ends of the multiple positioning posts are connected with the first steel grid frame, and the multiple positioning posts are inserted through the Styrofoam board; and in the fourth sub-step (A4), rear ends of the multiple positioning posts are connected with the second steel grid frame, wherein the method further comprises a step (F) of grouting a beam mould of the semi-finished hollow wall, wherein the beam mould has a beam reinforcement, a beam frame surrounding the beam reinforcement and connected on a top of the semi-finished hollow wall, multiple connection pipes separately extending through the beam reinforcement, and multiple Styrofoam blocks separately extending across the beam reinforcement in a step (G), the curable liquid material is grouted into the beam frame and is not higher than tops of the multiple connection pipes; a step (H) removing the beam frame after the curable liquid material is solidified in the beam frame so as to obtain a semi-finished beam connected on the top of the semi-finished hollow wall; and a step of removing multiple air passages formed on the multiple Styrofoam blocks, wherein the multiple connection pipes have multiple orifices defined thereon and corresponding to the multiple air passages respectively, thus producing a beam; in the step (D), the connection channel is in communication with bottoms of the multiple connection pipes, and wherein the beam is connected with a ceiling and has a sound insulation device arranged thereon, the sound insulation device has a metal mesh, a sound absorbing foam, and another metal mesh which are solidified after the grouting of step (F) grouting, wherein the sound absorbing foam is defined between the two metal meshes.

2. The method as claimed in claim 1, wherein in the fourth sub-step (A4), the Styrofoam board has the multiple second extensions spaced apart from each other and located beside two sides of the first extension individually, the first extension abuts against the multiple second extensions; in the step (D), the inflow conduit is communicated with the connection channel.

3. The method as claimed in claim 1, wherein in the step (D), a heating device is fixed in the communication space of the hollow wall.

* * * * *